United States Patent [19]

Freudenschuss

[11] Patent Number: 4,790,731

[45] Date of Patent: Dec. 13, 1988

[54] FUEL INJECTION PUMP FOR DIESEL ENGINES

[75] Inventor: Otto Freudenschuss, Vienna, Austria

[73] Assignee: Steyr-Daimler Puch AG, Vienna, Austria

[21] Appl. No.: 128,047

[22] Filed: Dec. 3, 1987

[30] Foreign Application Priority Data

Dec. 10, 1986 [AT] Austria ..... 3270/86

[51] Int. Cl.[4] ..... F02M 59/32

[52] U.S. Cl. ..... 417/490; 123/502

[58] Field of Search ..... 417/490; 123/502, 501, 123/500, 508, 90.46, 90.55, 90.63

[56] References Cited

U.S. PATENT DOCUMENTS

| | | | |
|---|---|---|---|
| 2,863,438 | 12/1958 | Challis | 123/502 |
| 3,859,973 | 1/1975 | Dreisin | 123/502 |
| 4,249,499 | 2/1981 | Perr | 123/502 |
| 4,254,749 | 3/1981 | Krieg et al. | 123/502 |
| 4,407,241 | 10/1983 | Butler et al. | 123/501 X |
| 4,410,138 | 10/1983 | Peters et al. | 239/95 |
| 4,621,605 | 11/1986 | Carey, Jr. et al. | 123/502 X |

*Primary Examiner*—Leonard E. Smith

*Attorney, Agent, or Firm*—Marmorek, Guttman & Rubenstein

[57] ABSTRACT

A fuel injection pump for diesel engines comprises a housing, which contains a cylinder sleeve that has at least one radial fuel port. An injector plunger is slidably mounted in the cylinder sleeve and has two axially spaced apart valving edges for cooperation with the fuel port. The plunger is coupled to a plunger follower, which is movably mounted in the housing and which is operable by a camshaft via an actuating member against the force of a return spring. The stroke position of the plunger is adjustable by means of a stop, which is adjustable by means of a timing piston, which is movable in a timing cylinder, which is supplied with hydraulic oil through a check valve. To simplify the structure and to permit the stroke position of the plunger to be adjusted at a high speed, the timing cylinder is constituted by the plunger follower and is formed with an oil outlet port, which communicates with an outlet opening of the housing at the end of the discharge stroke of the plunger. The plunger is coupled to the plunger follower with an axial backlash, which is adapted to be reduced by means of the timing piston.

4 Claims, 2 Drawing Sheets

FUEL INJECTION PUMP FOR DIESEL ENGINES

BACKGROUND OF THE INVENTION

1. Field of the Invention

This invention relates to a fuel injection pump for diesel engines comprising a housing which contains a pump cylinder sleeve that has at least one radial fuel port and a plunger that is slidably mounted in the cylinder sleeve and has two axially spaced apart valving edges, which cooperate with the fuel port, and a cylindrical plunger follower, which is movably mounted in the housing and coupled to the plunger and is moved against the force of a return spring by an actuating member which is driven by a camshaft, wherein the stroke position of the plunger is adjustable by means of a stop, which is adjustable by means of a timing piston, which is disposed in a timing cylinder and is adapted to be supplied with oil under pressure through a check value and is adjustable to a limited extent, and wherein an oil passage leads into the plunger follower.

2. Description of the Prior Art

A change of the stroke position of the plunger or a change of the initial position of the valving edges of the plunger relative to the fuel port in the cylinder sleeve will result in a change of the timing of the beginning of the discharge by the fuel injection pump and of the injection of fuel into the combustion chanber of the diesel engine. A decrease of the distance existing between the valving edge which determines the beginning of the discharge stroke and the fuel port when the plunger is in the corresponding dead center position will have the result that the stroke position of the plunger is shifted toward said port and the valve edge will sooner arrive at the fuel port so that the discharge will begin sooner after the fuel port has been closed. The discharge of fuel will begin later when the distance is increased that exists between the valving edge and the fuel port when the piston is in its dead center position assumed at the beginning of the discharge stroke.

A fuel injection pump of the kind described first thereinbefore is known from U.S. Pat. No. 3,859,973. In that pump the actuating member which acts against the plunger follower against the force of the return spring is operated by the camshaft via a rocker lever, which at its end that is adjacent to the pump contains an inserted cylinder sleeve which has a cylinder opening in which the timing piston is accommodated. The stroke of the timing piston is limited by a crosspin, which extends through the timing piston in a bore with a relatively large radial clearance. The rocker lever contains bores for conducting hydraulic oil which is supplied under pressure and which open into the cylinder opening through a disc check valve. The return spring for the plunger cooperates with an abutment, which is not rigid with the plunger follower but is connected to the latter by a weaker spring, which serves as a return spring for the timing piston. The actuating member is interposed between the free end face of the plunger follower and the timing piston so that the latter serves as a stop which determines the stroke position of the plunger and of the plunger follower. The coupling between the plunger and the plunger follower has virtually no backlash in the axial direction and the cylinder sleeve which contains the timing piston has no controlled oil outlet port. The oil passage which extends through the actuating member into the plunger follower is merely a passage for supplying lubricating oil to the sliding surfaces of the plunger flower and the housing. That arrangement has the disadvantage that the cylinder sleeve which contains the timing piston and the check valve are disposed in the end portion of the rocker arm. That arrangement involves a considerable structural expenditure and requires the rocker arm to have large dimensions so that its accommodation may be difficult. A particularly significant fact resides in that when the timing piston has been supplied with hydraulic oil in a sense to advance the beginning of the discharge from the fuel injection pump the timing piston can return only slowly to its initial position because a controlled outlet opening for the hydraulic oil is not provided and the hydraulic oil can only leak out between the cylinder sleeve and the timing piston. As a result, the adjusting speed is relatively low. Higher adjusting speeds could only be achieved if a higher leakage was tolerated but this would result in an appreciable loss of hydraulic oil from the working space in the cylinder sleeve during the discharge stroke. Such a loss of oil would result in a generally undesired increase of the duration of the injection of fuel. Owing to the time required by the oil to leak out of the timing cylinder, the frequency of the fuel injection pump is limited during the discharge stroke.

SUMMARY OF THE INVENTION

It is an object of the invention to eliminate the disadvantages set forth hereinbefore and to provide a fuel injection pump which is of the kind described first hereinbefore and which involves a smaller structural expenditure and permits a change of the stroke position of the injector plunger at a high speed.

It is another object of the invention to provide such a fuel injection pump which can be operated at a higher frequency.

That object is accomplished in accordance with the invention in that the timing cylinder is constituted by the plunger follower and is formed with an oil outlet port which at the end of the discharge stroke of the plunger and of the plunger follower communicates with an outlet port that is formed in the housing and the injector plunger is coupled to the plunger follower with an axial backlash which is adapted to be decreased by means of the timing piston.

In that case there will be no need for a separate cylinder sleeve which is accommodated in the rocker arm and contains the timing piston but the cylinder opening for the timing piston as well as the check valve are accommodated in the plunger follower, which is provided in any case. As a result, the structural expenditure is decreased, a compact structure is obtained and the actuation effected by the camshaft does not depend on a rocker arm. As the cylinder opening has an oil outlet bore, which communicates with an outlet of the housing at the end of the discharge stroke of the injector plunger, the hydraulic oil which has ben supplied to the timing piston to adjust the stop in a sense to advance the beginning of the discharge can escape immediately after the end of the discharge stroke and the timing piston can then return to its initial position so that the adjustment at the high speed desired is ensured. That controlled discharge of hydraulic oil from the timing cylinder is permitted only because the timing cylinder is constituted by the plunger follower and the latter performs a valving movement relative to the housing. It the hydraulic oil is supplied to the timing cylinder by means of a pressure control valve, the beginning of the discharge of the fuel injection pump can be changed in a continuous manner.

Within the scope of the invention the cylinder opening for the timing piston is defined by a coupling member, which has been inserted and preferably screwed into the plunger follower and is formed with a recess which accommodates an enlarged coupling end portion of the injector plunger and the timing piston has an extension which extends through the coupling member and acts directly on the end of the pump piston. Owing to that arrangement the parts can easily be assembled and the further advantage is obtained that the displacement of the timing piston and the distance over which the stop is adjustable can easily be determined because the coupling portion limits the cylinder opening in one direction and can be inserted or screwed to different depths into the plunger follower, particularly if a fine screw threads are used.

DETAILED DESCRIPTION OF THE PREFERRED EMBODIMENT

Figure 1:
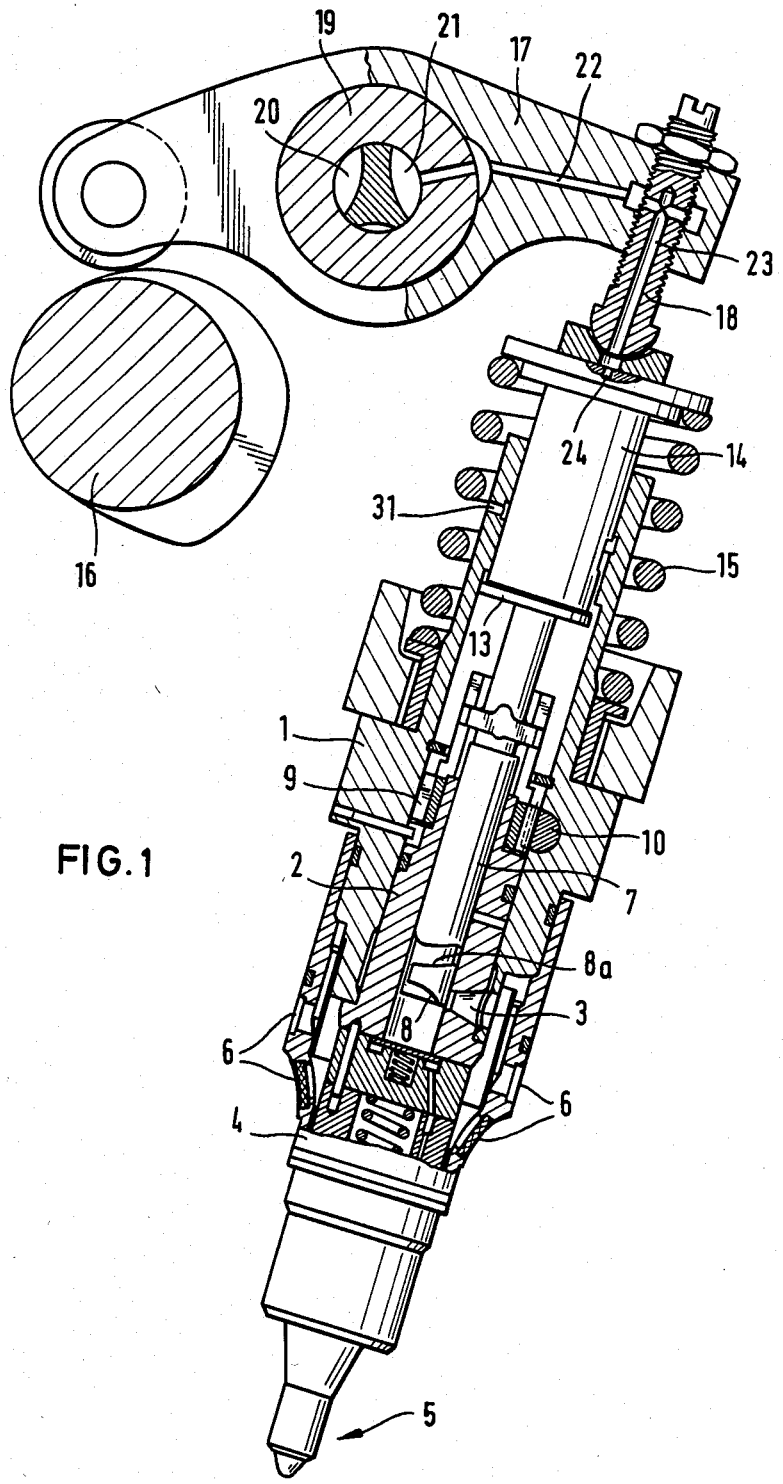
FIG. 1 is an axial view showing partly in section a fuel injector unit comprising a fuel injection pump and a fuel injection nozzle.

A cylinder sleeve 2 which constitutes an injector pump cylinder is inserted in a housing 1. The cylinder sleeve 2 has a radial fuel port 3. The housing 1 is assembled together with the housing 4 of the fuel injection nozzle 5. The housing 4 has ports 6 for receiving and discharging fuel. The ports 6 register with corresponding bores in the cylinder head or in other parts of the diesel engine. The cylinder sleeve 2 which constitutes a fuel injection pump cylinder contains a plunger 7, which comprises two valving edges 8, 8*a*, which cooperate with the fuel port 3. By means of a gear 9 and a rack 10 the plunger 7 can be rotated to move other portions of the valving edges 8, 8*a* into axial alignment with the fuel port 3 so that the quantity of fuel which is discharge per stroke can be changed.

The plunger 7 comprises an end portion 11, which is enlarged to form a coupling element and is held with an axial backlash in an undercut recess 12 of a coupling member 13. The coupling member 13 is screwed with fine screw threads in a cylindrical plunger follower 14, which is slidably mounted in the housing 1. The injector plunger 7 is actuated for its discharge stroke by a camshaft 16 via a rocker arm 17 and an actuating member 18 acting on the plunger follower 14 against the force of the return spring 15. The pivot 19 for the rocker arm 17 is formed with a longitudinal passage 20 for lubricating oil and with another passage 21 for hydraulic oil, which flows through additional oil passages 22, 23, 24 into the plunger follower 14. A check valve 25 is incorporated in the hydraulic oil passage 24.

The plunger follower 14 constitutes a timing cylinder, which has a cylinder opening 26, which is defined by a coupling member 13 and which contains a timing piston 27. An extension 28 of the timing piston 27 slidably extends through the timing piston and constitutes a stop, which acts directly on the enlarged end portion 11 of the plunger 7. A return spring 29 biasing the timing piston 27 is wound around the extension 28. Owing to the coupling effected by the coupling member 12 and the enlarged end portion 11, the plunger 7 moves in unison with the plunger follower 14, subject to the lost motion that is due to the axial backlash defined by the stop 28. The cylinder opening 26 communicates with an oil outlet port 30, which at the end of the discharge stroke of the plunger 7 and the plunger follower 14 registers with an outlet port 31 of the housing 1.

The displacement of the timing piston 27, the forces of the return springs 15 and 29, and the flow area of the ports 30 and 31 are so selected that the return spring 29 can return the timing piston 27 to an initial position immediately after the discharge stroke of the plunger until the return spring 15 has moved the plunger follower 14 to a position in which the ports 30 and 31 no longer communicate with each other.

Figure 2:
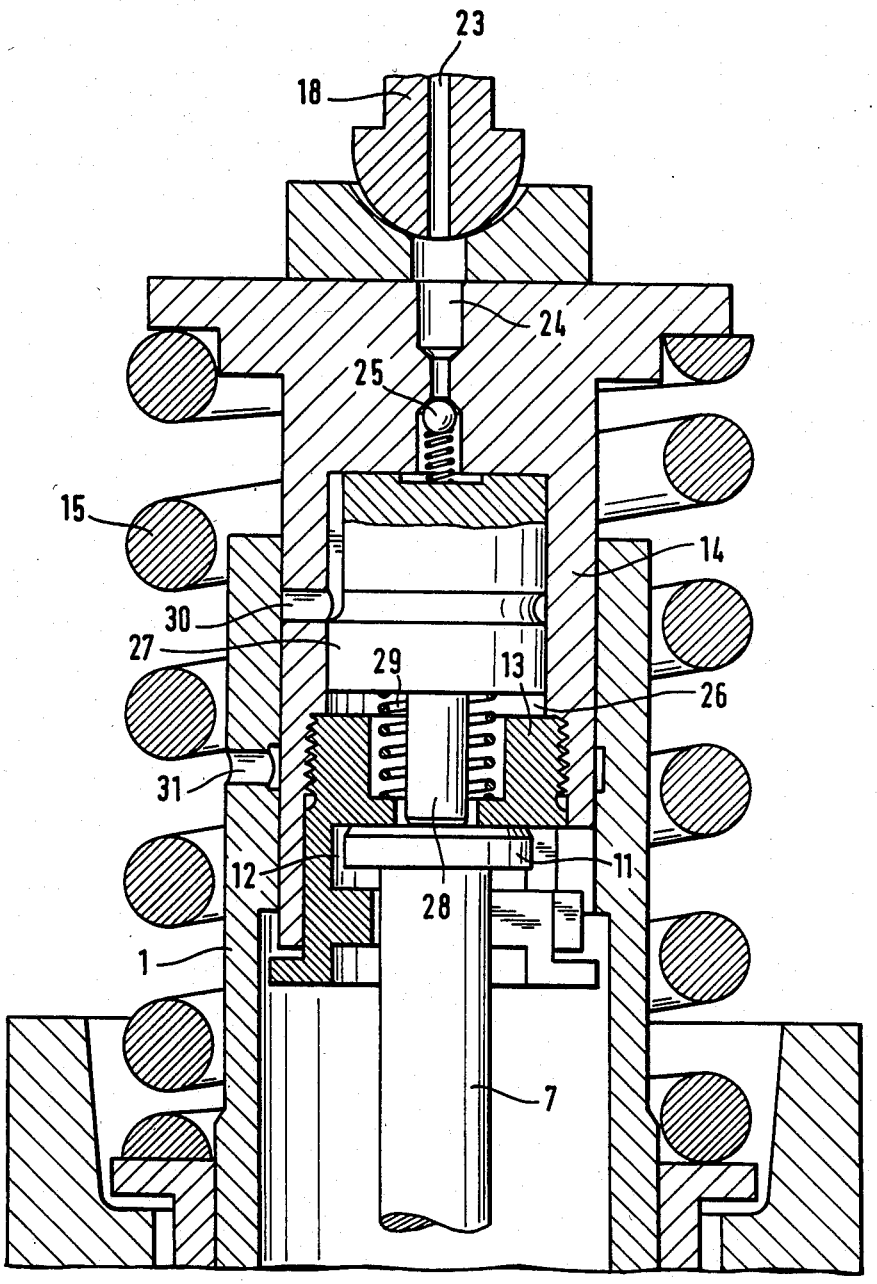
FIG. 2 is an enlarged axial sectional view showing those parts of the fuel injection pump which are essential for an understanding of the invention.

FIG. 2 shows the injector plunger 7 in the position for the latest beginning of the discharge by the fuel injection pump. When hydraulic oil is supplied through the passages 21, 22, 23, 24 into the cylinder opening 26 to apply pressure to the timing piston 27, before the discharge stroke of the plunger 7, the timing piston 27 will be displaced against the force of the return spring 29 and within the extent of the existing axial backlash of the coupling end portion 11 of the plunger 7 the latter will be displaced downwardly in the recess 12. This results in an advance of the beginning of the discharge. At the end of the discharge stroke the hydraulic oil leaves the cylinder opening 26 through the outlet port 30 and 31 so that the return spring 29 displaces the timing piston 27 to its initial position. It will be understood that the hydraulic oil must again be supplied to the timing piston 27 if the advance of the beginning of the discharge is to be maintained.

I claim:

1. In a fuel injection pump for a diesel engine, comprising a housing, a pump cylinder sleeve mounted in said housing and having at least one radial fuel port, an injector plunger, which is slidably mounted pump cylinder sleeve for a discharge stroke and has two axially spaced apart valving edges for cooperation with said fuel port, a cylindrical plunger follower, which is slidably mounted in said housing and axially coupled to said plunger, an actuating member axially engaging said plunger follower, a camshaft cooperating with said actuating member to impart via said actuating member an axial movement to said plunger follower and via said plunger follower to said plunger, a first return spring opposing said axial movement of said plunger follower, an axially adjustable stop, which is engageable by said injector plunger to determine the stroke position of said plunger, a hydraulic timing cylinder, a timing piston, which is slidably mounted in said timing cylinder for a limited stroke and is coupled to said stop and operable to adjust said stop, an oil supply line comprising a check valve and connected to said timing cylinder, and an oil passage leading from said oil supply line into said plunger follower, the improvement residing in that said timing cylinder is constituted by said plunger follower and is formed with a first oil outlet port, said housing is formed with a second outlet port, which is aligned with said first outlet port in the axial direction of said plunger follower, said injector plunger is coupled to said plunger follower with an axial backlash and is arranged to assume at the end of said discharge stroke a position in which said first and second outlet ports register and communicate with each other, and said timing piston is movable from a predetermined initial position in a first direction to reduce said axial backlash by axially adjusting said stop in response to a supply of hydraulic oil to said timing cylinder, and a second return spring is provided, which opposes the movement of said timing piston in said first direction.

2. The improvement set forth in claim 1, wherein said plunger follower is formed with an axially extending through opening, a coupling member is mounted in said through opening and defines therein a cylinder opening at the end of said plunger follower which is remote from said plunger, said timing piston is slidably mounted in said cylinder opening, said coupling member is formed with an undercut recess which is open toward said plunger, said plunger has an enlarged end portion, which is coupled to said coupling member in said recess with said axial backlash, said stop is rigid with said timing piston and axially protrudes therefrom and is adapted to protrude through said coupling member into said recess for engagement with said enlarged end portion of said plunger.

3. The improvement set forth in claim 2, wherein said coupling member is screwed into said through opening.

4. The improvement set forth in claim 1, wherein the displacement of said timing piston, the forces of said first and second return springs, and the flow area of said first and second ports are so selected that said second return spring is adapted to return said timing piston to said initial position immediately after the discharge stroke of said plunger until said first return spring has moved said plunger follower to a position in which said first and second ports no longer communicate with each other.

* * * * *